United States Patent [19]

McConnell, Jr.

[11] 4,264,236

[45] Apr. 28, 1981

[54] UNDERWATER SHOCK CONTROL SYSTEM

[75] Inventor: John W. McConnell, Jr., Idaho Falls, Id.

[73] Assignee: Energy Incorporated, Idaho Falls, Id.

[21] Appl. No.: 47,196

[22] Filed: Jun. 11, 1979

[51] Int. Cl.[3] ..... E02D 31/00; F16F 9/16

[52] U.S. Cl. ..... 405/211; 188/311; 405/212

[58] Field of Search ..... 405/173, 195, 211, 212; 52/167; 114/219; 267/124; 188/270, 279, 311

[56] References Cited

U.S. PATENT DOCUMENTS

| | | | |
|---|---|---|---|
| 1,151,595 | 8/1915 | Ingham | 188/311 |
| 2,405,502 | 8/1946 | Harris | 114/219 X |
| 3,059,269 | 10/1962 | Selinger et al. | 188/311 X |
| 3,418,768 | 12/1968 | Cardan | 52/167 |
| 3,741,559 | 6/1973 | Ross | 267/124 |
| 3,854,706 | 12/1974 | Johnston | 114/219 X |
| 4,043,545 | 8/1977 | Dial et al. | 114/219 X |

*Primary Examiner*—David H. Corbin

*Attorney, Agent, or Firm*—Lynn G. Foster

[57] ABSTRACT

An underwater shock control system, including apparatus and method, the apparatus comprising one or more large underwater cylinder shock or dynamic load dampeners especially adapted to protect against seismic loads (particularly in a high gamma radiation environment) while allowing movement due to temperature. Each underwater cylinder is mounted between underwater equipment to be stabilized and underwater support structure. Each underwater cylinder uses the surrounding water as the working hydraulic fluid which water is drawn in and expelled through various orifices in the cylinder by relative movement between the equipment and support structure.

4 Claims, 2 Drawing Figures

UNDERWATER SHOCK CONTROL SYSTEM

BACKGROUND

1. Field of Invention

The present invention relates generally to damping shock load movement and allow expansion and contraction due to temperature change. More particularly to an underwater cylinder which uses the water as a medium by which seismic shock to underwater equipment is resisted.

2. Prior Art

It being necessary to store equipment underwater. Sometimes the equipment will contain nuclear fuel creating a high gamma radiation environment. Protection from the dangers of seismic loads which might cause loss or destruction of the equipment and also result in contamination and pollution of the water.

The Applicant is aware of U.S. Pat. No. 4,015,835, French Pat. No. 2,221,953, Russian Pat. No. 376,615 and West German Pat. No. 2,502,769. None of these deal directly or inferentially with resisting, reducing and damping nuclear shock underwater (with or without benefit of a cylinder) and none in anyway suggests use of the surrounding water as the medium by which said resistance, reduction and damping is effectuated.

BRIEF SUMMARY AND OBJECTS OF THE INVENTION

In brief summary, the present invention comprises a submerged shock load control system which allows for displacement (caused by temperature change), including method and apparatus, the apparatus comprises one or more submerged cylinders interposed between submerged equipment and a support site, each cylinder using the liquid in which it is submerged as the medium by which the shock load is resisted, reduced and damped and temperature change displacement is accepted. The invention is especially adapted for use in conjunction with underwater nuclear facilities where a high gamma radiation environment is created.

With the foregoing in mind, it is a primary object of the present invention to provide a novel submerged shock load and displacement control system, including apparatus and method.

A further paramount object is the provision of one or more submerged cylinders interposed between submerged equipment and a support site and using the liquid in which it is submerged as the medium by which shock, load and displacement are resisted, reduced and damped.

A further object of the invention is to provide an underwater control to protect underwater equipment from shock load and displacement especially submerged equipment containing nuclear material and which may create a high gamma radiation field.

A further objective of this invention is to make provision for and allow thermal expansion and contraction of the equipment.

Another object of the invention is to provide simple adjustment to the length of underwater equipment to adapt to differences in fabrication of mating systems.

Another object of the invention is to provide a submerged cylinder for resisting movement of submerged equipment, and materials of consturction of the cylinder being such as to be compatible with the fluid in which it is submerged.

These and other objects and features of the present invention will be apparent from the following detailed description taken with reference to the accompanying drawings.

DETAILED DESCRIPTION OF THE ILLUSTRATED EMBODIMENT

Figure 1:
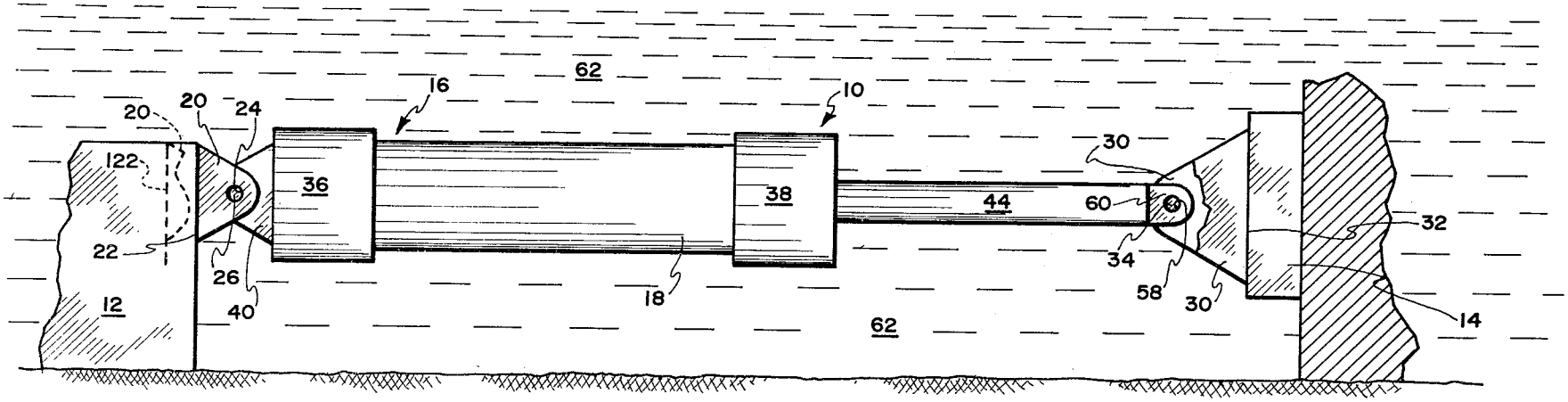
FIG. 1 is a fragmentary side elevation view of a displacement control system according to the present invention comprising a submerged cylinder interposed between underwater equipment and a support site.
Figure 2:
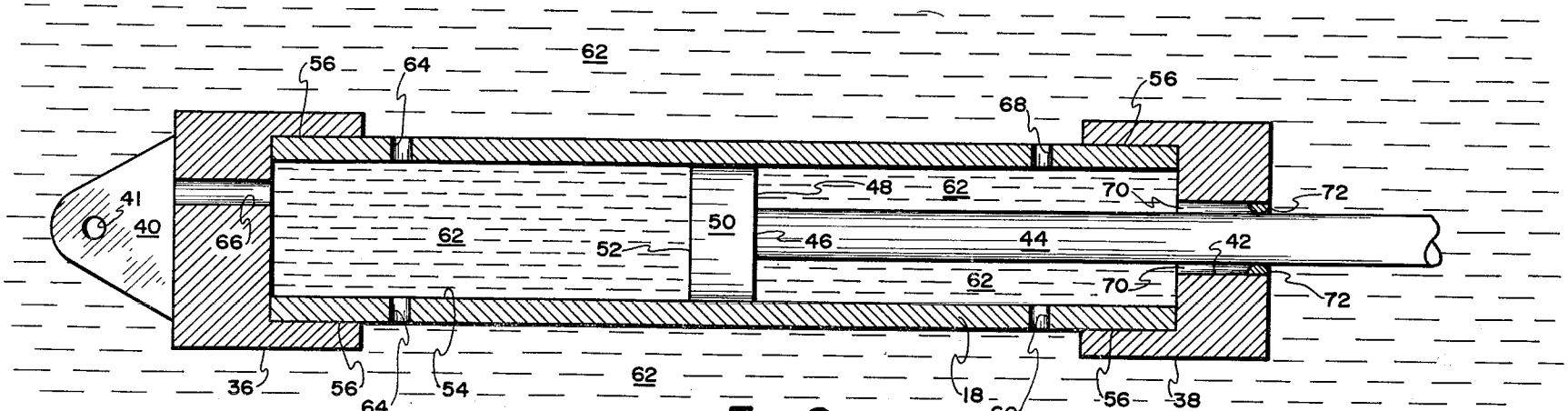
FIG. 2 is a longitudinal cross section of the submerged cylinder of FIG. 1.

Reference is now made to the drawings wherein like numerals are used to designate like parts throughout and which illustrate a submerged displacement control apparatus, generally designated 10 pivotally interposed between submerged equipment 12 and a support 14 adjacent to but spaced from the equipment 12.

The equipment 12 may comprise an underwater nuclear component creating a high gamma radiation environment therein which if subjected to substantial unrestrained seismic loads would not only risk destruction of the nuclear component but also present a real threat of radioactive contamination and pollution of the liquid environment.

The equipment 12 is illustrated as comprising a pair of parallel exposed lugs 20 (only one of which is shown), each of which is rigidly anchored at site 22 to the equipment 12. Each lug 20 comprises an aperture 24, the two apertures 24 being horizontally aligned in the illustrated embodiment to receive a pivot pin 26.

The support 14 comprises a pair of exposed parallel lugs 30, each lug 30 being rigidly secured at site 32 to the support 32. Each lug 30 comprises an aperture, the apertures of the two lugs being horizontally aligned to receive a pivot pin 34.

The controlled apparatus 10 comprises a large two way cylinder assembly 16 having no seals which stabilizes the equipment. Cylinder 16 comprises a hollow right circular cylindrical housing 18 and trailing and forward end caps 36 and 38, respectively. Integrally connected to the trailing end cap 36 and projecting outwardly substantially axially is lug 40, which has an aperture 41 through which pivot pin 26 pivotally passes. Thus, the trailing end of the cylinder assembly 16 is pivotally connected to the equipment 12. It is to be appreciated that the illustrated and described pivotal connection could be of any available type including those which accommodate bi-axial rotation. The leading end cap 38 comprises an axial bore 42 through which a piston rod 44 extends coaxially with the axis of the cylindrical housing 18. The interior end of the rod 44 is integrally joined at site 46 to side 48 of a piston 50, the other side 52 of the piston facing the interior of the trailing end cap 36. The piston 50 is snugly disposed through reciprocally within the hollow 54 of the cylindrical housing 18 - in a central at rest position when not subjected to stress. In most installations the piston fit will be close tolerance.

The cylindrical housing 18 is caused to be made integral at annular sites 56 with the end caps 36 and 38 by welding, threads or in any other satisfactory way.

The distal end of the rod 44 comprises an aperture 58 disposed across two opposed flat surfaces 60 through which pivot pin 34 passes. Accordingly, the cylinder assembly is pivotally joined to the support 14. While only one form of piston rod pivotal connection is illustrated and described, any other known type of pivotal connection could be utilized.

Significantly, the two way cylinder assembly 16 is submerged within liquid medium 62. The liquid medium, normally comprises water although other liquid environments would be appropriate. The liquid 62 is allowed to initially fill the interior 54 of the at rest cylindrical housing 18. This occurs at the trailing side of the piston 50 between piston surface 52 and end cap 36 through two or more ports 64 located on the upper and lower surfaces of cylinder 18 and one or more end cap ports 66. The forward end of the interior 54 of the at rest cylindrical housing 18 between piston surface 48 and the end cap 38 is likewise initially filled with the surrounding water 62 through two or more ports 68 located on the upper and lower surfaces of the housing 18 and through a space 70 between the rod 44 and the bore 42 centrally located in the end cap 38. Preferably spaced clearance guides 72 maintain the requisite axial alignment of the rod 44 for proper reciprocation while accommodating liquid flow through the space 70, the clearance guide 72 being conventionally interposed between the surface of the bore 32 and the adjacent surface of the rod 44.

It is to be appreciated that the size of the space 70 and the size and number of the ports 64, 66 and 68 will be selected to control, after the initial filling, the rate at which the liquid 62 is to be permitted to be displaced to and from the interior 54 of the cylindrical housing 18 on either side of the piston 50. If it is desired to provide only a moderate resistance to dynamic forces tending to displace the equipment 12, the higher rate of liquid displacement into and out of the cylinder is provided by incorporating more or larger cylinder ports. However, in most installations, particularly where the equipment 12 comprises a nuclear facility, the rate of liquid displacement will be substantially restricted so that rapid displacement is materially resisted, restrained and damped, but thermal movement is provided for.

The length of the assembled unit may be varied at installation to account for differences in fabrication and installation of the equipment and facility involved (12 and 14 on FIG. 1) and still remain within the working position of the piston 50 and the cylinder 18.

The materials from which the cylinder assembly 16 are made are such as to be compatible with the liquid environment in which the cylinder assembly is to be placed such as stainless steel and may be chemically or otherwise treated to provide adequate wear and corrosion resistance. It is preferred that the piston 50 and the rod 44 be of a material having greater hardness than the cylindrical housing 18 and the leading end cap 38.

The invention may be embodied in other specific forms without departing from the spirit or essential characteristics thereof. The present embodiment is therefore considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A displacement control apparatus continuously submerged in an ambient liquid and connected between an equipment site continuously submerged in said liquid and a support site continuously submerged in said liquid comprising:

an unbiased cylinder having a substantially closed hollow interior;

an unbiased piston reciprocably disposed within the hollow interior of the cylinder in a central location during a no stress state;

the hollow interior of the cylinder on both sides of the piston comprising said ambient liquid;

an unbiased rod connected to one side of the piston and extending at all times coaxially with the cylinder, the other end of the rod being exposed beyond the cylinder;

means carried by the rod at the exposed end thereof for pivotal connection to one of said sites;

means carried by the cylinder remote from the exposed rod end for pivotal connection to the other of said sites;

the cylinder comprising first and second open port means freely communicating said ambient liquid directly into and directly from the two sides of the piston within the cylinder to resist, reduce and damp dynamic forces tending to displace the equipment without applying a return force and yet allow for thermal expansion or contraction of the equipment or support.

2. A displacement control system comprising:

an ambient liquid environment;

equipment at a first site entirely submerged at all times within the ambient liquid;

a support site adjacent but spaced from the equipment site entirely submerged at all times within the ambient liquid;

an unstressed cylinder having a substantially closed hollow interior;

an unstressed piston reciprocably disposed within the hollow interior of the cylinder in a central location during each no stress state;

the hollow interior of the cylinder on both sides of the piston solely comprising said ambient liquid;

an unstressed rod connected to one side of the piston and extending coaxially with the cylinder, the other end of the rod being exposed beyond the cylinder;

means pivotally connecting the exposed end of the rod to one of said sites;

means pivotally connecting the cylinder, at a location remote from the exposed rod end, to the other of said sites;

the cylinder comprising first and second unvalved open port means having said ambient liquid disposed therein accommodating (a) initial filling of the hollow interior of the cylinder with said liquid on both sides of the piston and (b) direct ingress and egress of the liquid directly between the environment and the interior of the cylinder at each side of the piston to resist, reduce and damp each force tending to displace the equipment without application of a return force to the cylinder, the piston or the rod.

3. A displacement control system comprising:

a liquid ambient environment;

a nuclear facility creating a high gamma radiation environment at a first site submerged within the ambient environment;

a support site adjacent but spaced from the first site submerged within the ambient environment;

a cylinder having a ported hollow interior and being unstressed in its normal at rest condition;

a piston reciprocably disposed in an at rest unstressed condition within the hollow interior of the cylinder in a central location during each no stress state;

a rod connected to one side of the piston and extending coaxially with the cylinder, the other end of the rod being exposed beyond the cylinder, the rod being unstressed when at rest;

means pivotally connecting the exposed end of the rod to one of said site;

means pivotally connecting the cylinder, at a location remote from the exposed rod end, to the other of said sites;

the cylinder comprising first and second open port means directly joining the liquid of the environment with the liquid within the cylinder on both sides of the piston after accommodating initial filling of the hollow interior of the cylinder with said liquid on both sides of the piston and further accommodating ingress and egress of the liquid directly between the environment and the interior of the cylinder at each side of the piston to resist, reduce and damp each force tending to displace the facility, forces which displace the facility moving the cylinder in respect to the piston for the mentioned unstressed position to a different unstressed position.

4. A method of controlling displacement of submerged equipment comprising the steps of:

pivotally interposing a cylinder having a reciprocating piston between equipment at a first site and a support at a second site in an ambient liquid environment;

providing open access for the liquid in the surrounding environment to directly fill the interior of the cylinder on both sides of the piston under an initial no stress condition and for the liquid to be displaced at all times directly between the environment and the interior of the cylinder on either side of the piston when relative motion between the piston and the cylinder is caused by displacement of the equipment whereby the equipment displacement is resisted, reduced and damped and the relative position of the cylinder and the piston is moved from the mentioned unstressed location to a second different unstressed location without application of any return force.

* * * * *